US007798847B2

(12) United States Patent
Islam

(10) Patent No.: US 7,798,847 B2
(45) Date of Patent: Sep. 21, 2010

(54) INNER CONDUCTOR SEALING INSULATOR FOR COAXIAL CONNECTOR

(75) Inventor: Nahid Islam, Westmont, IL (US)

(73) Assignee: Andrew LLC, Hickory, NC (US)

( * ) Notice: Subject to any disclaimer, the term of this patent is extended or adjusted under 35 U.S.C. 154(b) by 231 days.

(21) Appl. No.: 12/246,656

(22) Filed: Oct. 7, 2008

(65) Prior Publication Data

US 2010/0087090 A1 Apr. 8, 2010

(51) Int. Cl.
*H01R 9/05* (2006.01)

(52) U.S. Cl. ..... 439/578; 439/278

(58) Field of Classification Search ..... 439/578–585, 439/278–279; 174/88 C See application file for complete search history.

(56) References Cited

U.S. PATENT DOCUMENTS

| | | | | |
|---|---|---|---|---|
| 5,803,767 | A | 9/1998 | Matsumoto | |
| 6,109,964 | A | 8/2000 | Kooiman | |
| 6,133,532 | A * | 10/2000 | Lundback et al. | 174/88 C |
| 6,203,368 | B1 | 3/2001 | Weidner | |
| 6,309,250 | B1 | 10/2001 | Hyzin | |
| 6,462,637 | B1 | 10/2002 | Laverick | |
| 6,848,941 | B2 | 2/2005 | Wlos et al. | |
| 6,890,208 | B2 * | 5/2005 | McCarthy | 439/394 |
| 6,893,290 | B2 | 5/2005 | Buenz et al. | |
| 7,077,700 | B2 | 7/2006 | Henningsen | |
| 7,347,727 | B2 * | 3/2008 | Wlos et al. | 439/578 |
| 7,448,906 | B1 * | 11/2008 | Islam | 439/578 |
| 2008/0009166 | A1 | 1/2008 | Raad et al. | |
| 2008/0045081 | A1 | 2/2008 | Studerus | |

FOREIGN PATENT DOCUMENTS

| | | |
|---|---|---|
| GB | 2387280 | 10/2003 |
| WO | 2004/055943 | 7/2004 |

OTHER PUBLICATIONS

Salojarvi, Kristiina: European Search Report for EP09012084, EPO counterpart patent application, issued Dec. 15, 2009, The Hague, Netherlands.

* cited by examiner

*Primary Examiner*—Edwin A. Leon
(74) *Attorney, Agent, or Firm*—Babcock IP, PLLC

(57) ABSTRACT

An insulator for supporting an inner contact within a coaxial cable connector; the coaxial cable connector for coupling with a coaxial cable having an outer conductor and an inner conductor. The insulator formed as a monolithic dielectric body provided with a mounting portion proximate a connector end, the mounting portion dimensioned to seat within a connector body of the coaxial cable connector. A bore through the dielectric body dimensioned to seat the inner contact therein provided with an annular first seal groove in an inner diameter of the bore proximate a cable end, an inner conductor seal disposed in the first seal groove. The inner conductor seal dimensioned to seal between the insulator and the inner conductor when the inner conductor is coupled to the inner contact.

20 Claims, 6 Drawing Sheets

INNER CONDUCTOR SEALING INSULATOR FOR COAXIAL CONNECTOR

BACKGROUND OF THE INVENTION

1. Field of the Invention

The invention relates to electrical connectors for coaxial cable. More particularly the invention relates to a coaxial cable insulator that provides an environmental seal for at least the inner conductor to inner contact electrical interconnection.

2. Description of Related Art

Prior coaxial connectors typically rely upon multiple seals between the connector, coaxial cable and/or interface element joints to prevent entry of moisture and/or humid air. The plurality of environmental seals significantly increases the complexity of the coaxial connector manufacture as well as assembly and installation procedures.

Competition within the coaxial cable and connector industry has focused attention upon improving electrical performance as well as reducing manufacturing, materials and installation costs.

Therefore, it is an object of the invention to provide a method and apparatus that overcomes deficiencies in such prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Prior coaxial cables typically have inner and outer conductors made from copper and copper alloy. The inventor has recognized that new coaxial cable configurations and/or materials such as inner and/or outer conductors of aluminum and/or aluminum with copper or other metallic outer coating may require improved protection of the electrical interconnection, especially when these materials are connected to the dissimilar metals commonly applied to electrical connectors.

The environmental seals in prior coaxial connectors are typically located around entry paths through the connector body and therefore do not protect the electrical interconnection between the inner conductor and the inner contact from any moisture which (a) may migrate past environmental seals of the connector body, (b) is sealed within the connector during installation and/or (c) may migrate to the electrical interconnection area along the inside of the coaxial cable.

An installation error and/or failure of any one of these connector body environmental seals may allow moisture and/or humid air to enter the connection areas of the connector where it can pool and cause corrosion resulting in significant performance degradation of the electrical connections.

In the case of metals such as aluminum, an oxide film is formed on surfaces exposed to atmosphere in a very short time (within seconds). Also, accelerated galvanic corrosion can occur between aluminum and other metals in presence of an electrolytic solution, such as water.

In a coaxial connector incorporating an inner conductor sealing insulator according to the invention, local isolation of the interconnection area is provided, reducing the overall seal area required and improving the reliability of the environmental seal.

Figure 1:
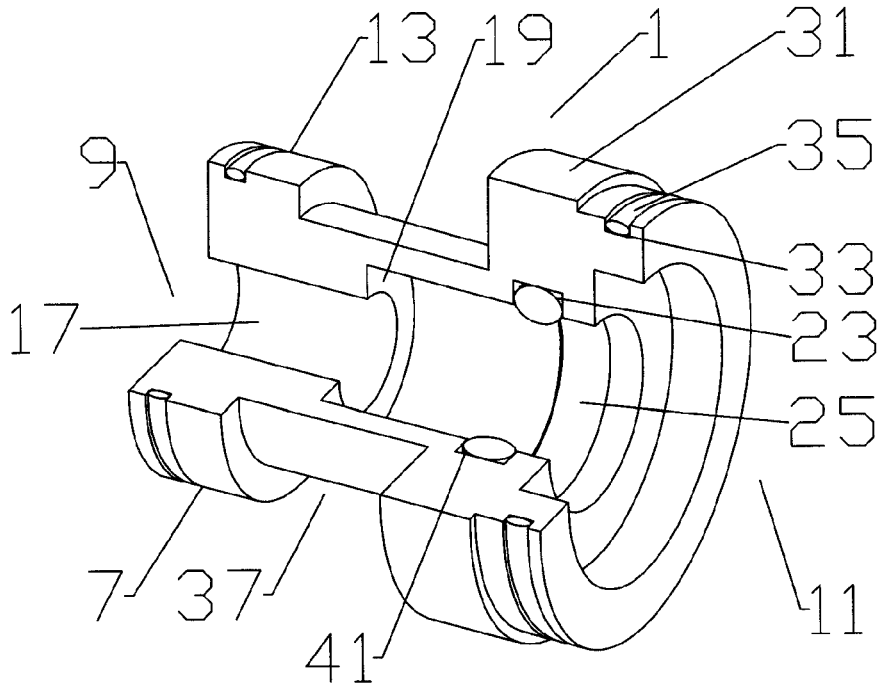
FIG. 1 is a schematic isometric 90 degree cut-away view of a first exemplary insulator.
Figure 2:
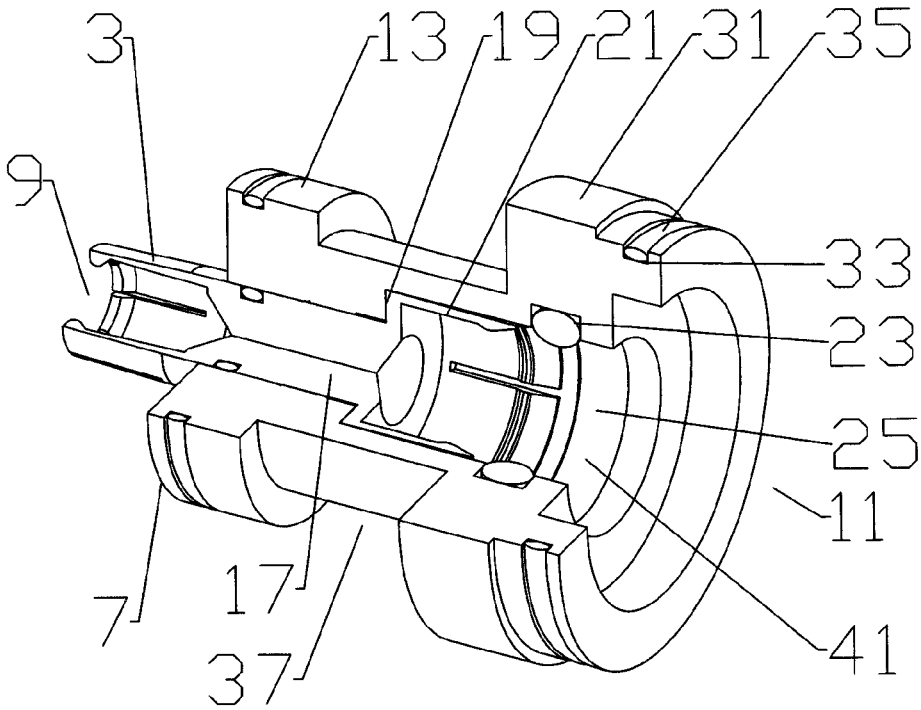
FIG. 2 is a schematic isometric 90 degree cut-away view of FIG. 1, including an inner contact.
Figure 3:
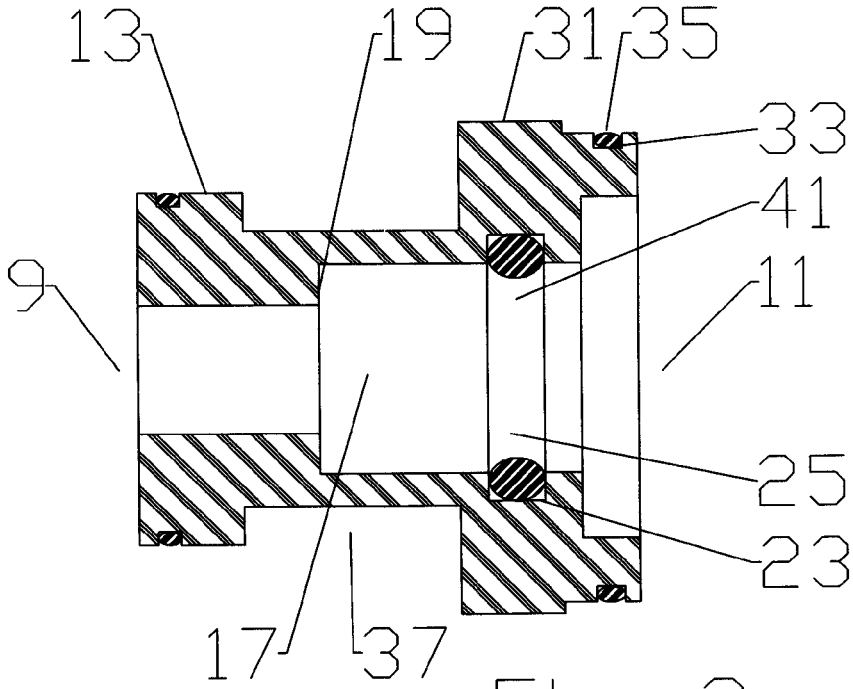
FIG. 3 is a schematic cut-away side view of FIG. 1.

An insulator 1 (best demonstrated in FIGS. 1-4) for supporting an inner contact 3 (FIG. 2) within a coaxial cable connector assembly 5 (FIGS. 5-9) is formed as a monolithic dielectric body 7 with a connector end 9 and a cable end 11 (these end designations along the insulator 1 longitudinal axis are hereinafter similarly applied to individual elements of the insulator 1, and associated coaxial cable connector assembly 5) provided with a mounting portion 13 proximate the connector end 9. The outer diameter of the mounting portion 13 may be dimensioned to seat the insulator 1 within a connector body 15 of the coaxial cable connector assembly 5.

A bore 17 through the dielectric body 7 is dimensioned to seat the inner contact 3 therein, retaining the inner contact 3 coaxial with the connector body 15. The bore 17 may be formed with an inner diameter that increases between the connector end 9 and the cable end 11, for example via a step 19 against which an increased diameter contact portion 21 of the inner contact 3 bottoms, preventing further movement of the inner contact 3 towards the connector end 9.

Figure 4:
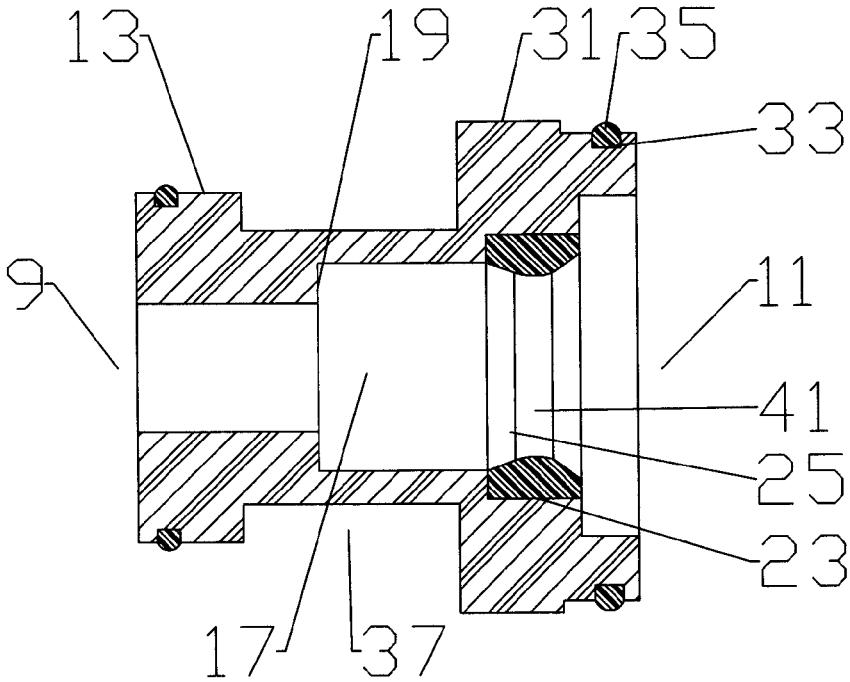
FIG. 4 is a schematic cut-away side view of an insulator demonstrating over-molded seals.
Figure 5:
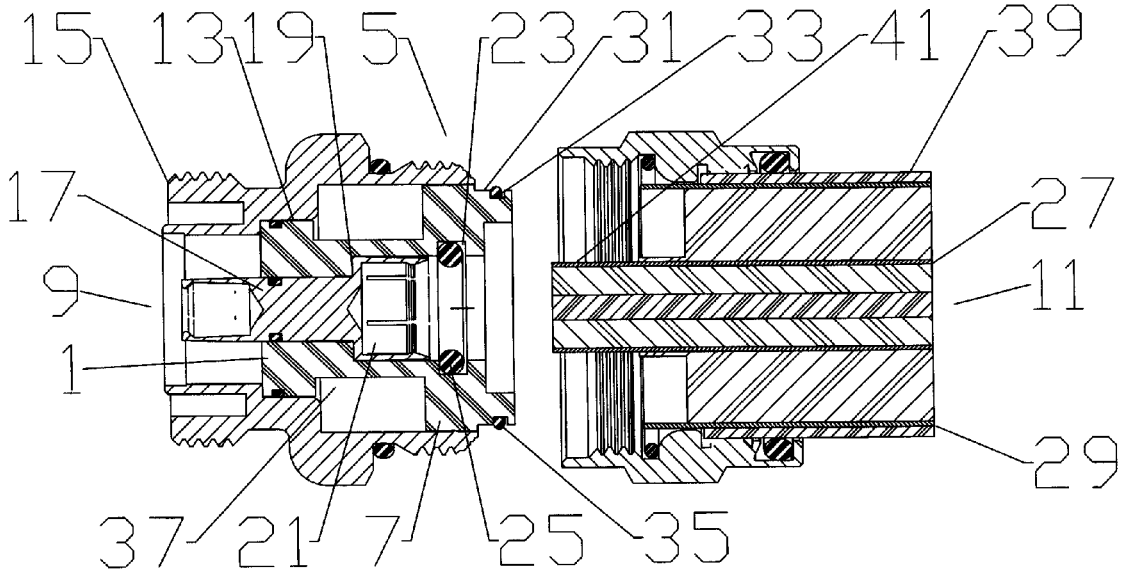
FIG. 5 is a schematic cut-away side view of a first exemplary coaxial cable assembly with an insulator according to the invention, prepared for coaxial cable attachment.
Figure 6:
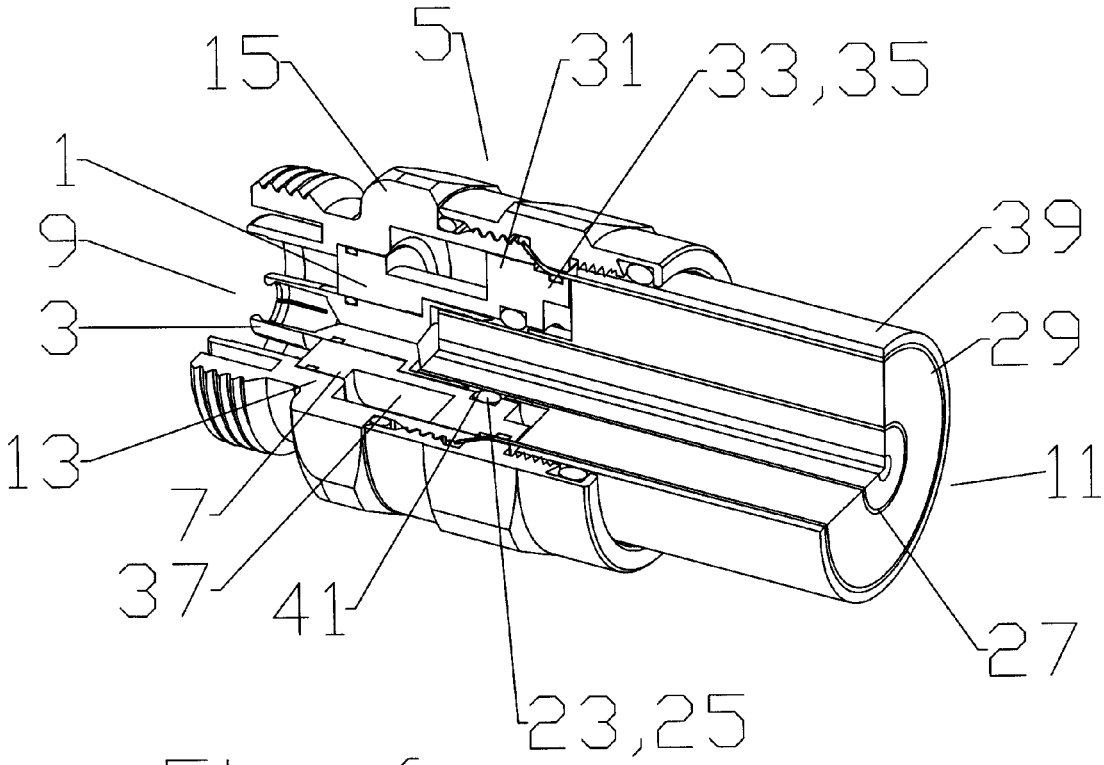
FIG. 6 is a schematic isometric 90 degree cut-away view of the embodiment of FIG. 5, with coaxial cable attached.
Figure 7:
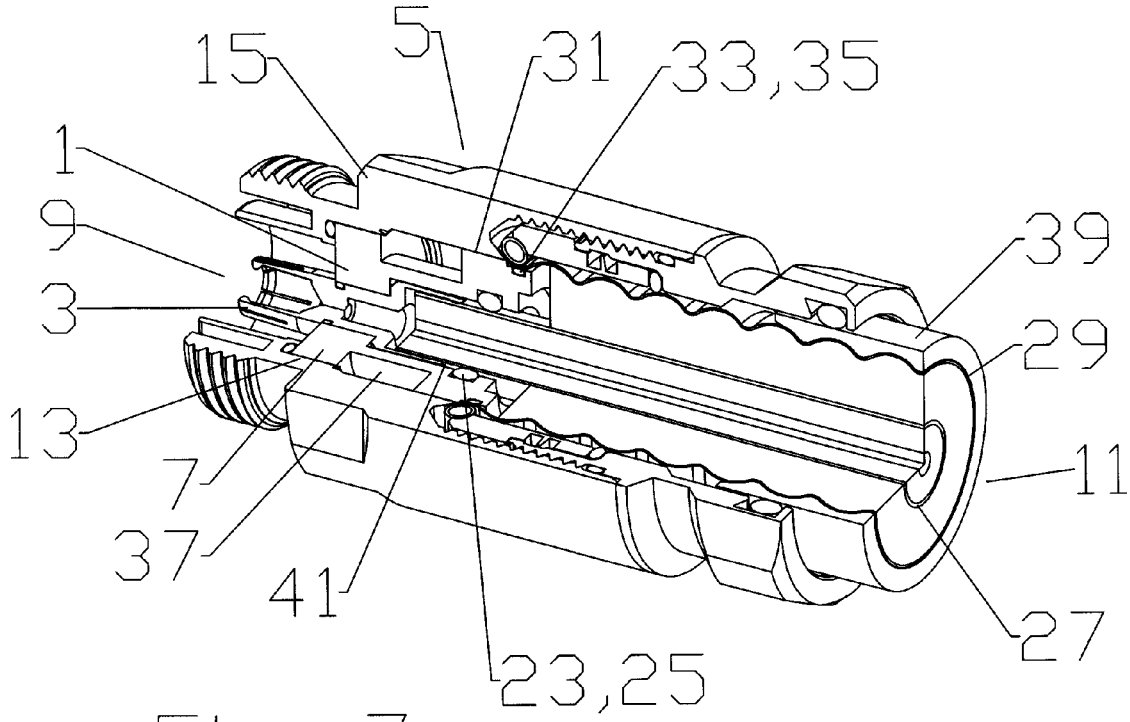
FIG. 7 is a schematic isometric 90 degree cut-away view of a second exemplary embodiment of a coaxial cable assembly, with coaxial cable attached.
Figure 8:
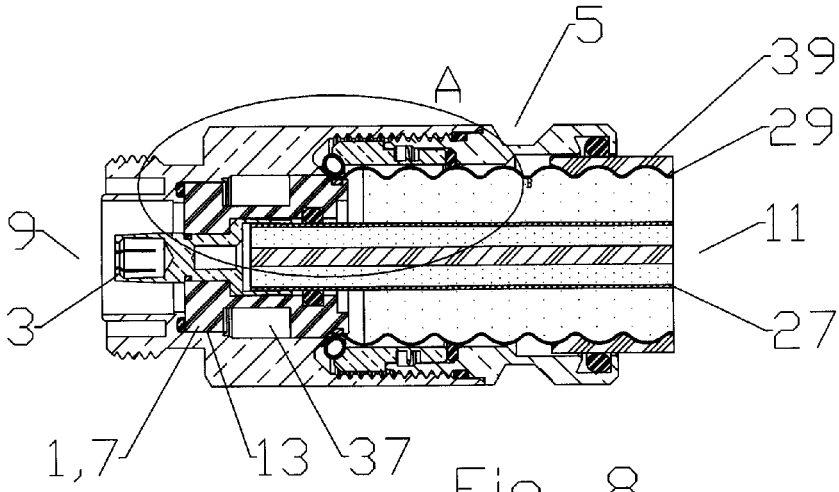
FIG. 8 is a schematic cut-away side view of FIG. 7.
Figure 9:
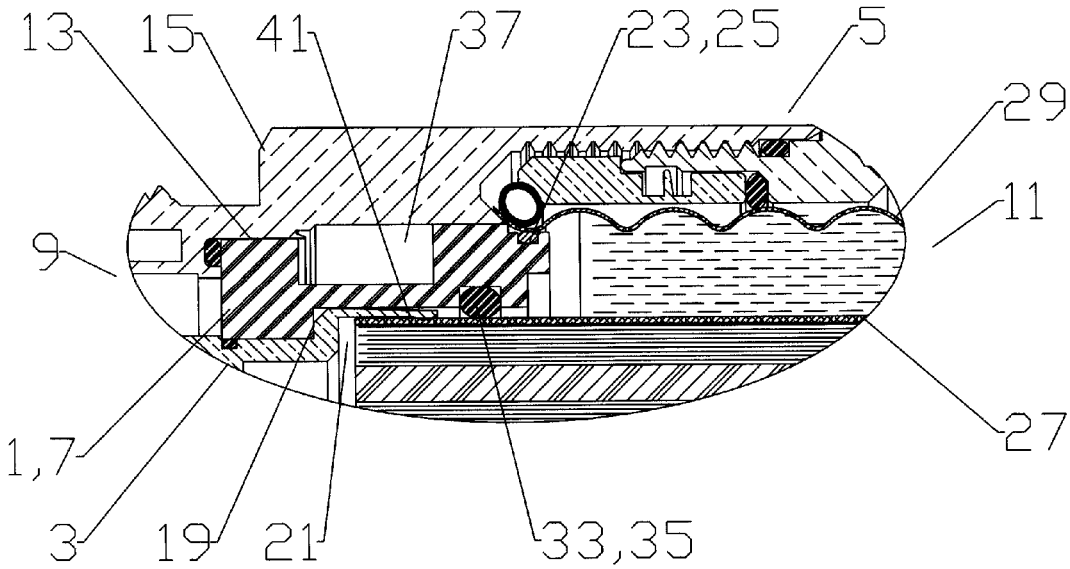
FIG. 9 is a close-up view of area A of FIG. 8.

An annular first seal groove 23 is provided in an inner diameter of the bore 17 proximate the cable end 11. An inner conductor seal 25 is disposed in the first seal groove 23, for example an o-ring or other form of annular gasket. To improve the inner conductor seal 25 seal characteristics and/or minimize the chance for misplacing and/or unseating the inner conductor seal 25 during assembly and/or cable to connector installation, the inner conductor seal 25 may be over-molded upon the dielectric body 7 (FIG. 4). The inner conductor seal 25 is dimensioned to seal between the insulator 1 and the inner conductor 27 as the inner conductor 27 is inserted to couple with the inner contact 3.

Similar to the sealing of the electrical connection between the inner conductor 27 and the inner contact 3, the insulator 1 may also be configured to provide a seal against the inner diameter of the outer conductor 29. For example, an outer diameter aligning portion 31 of the dielectric body 7 proximate the cable end 11 may be provided with an annular second seal groove 33 around the outer diameter. The second seal groove 33 receives an outer conductor seal 35 dimensioned to seal between the insulator 1 and an inner diameter of the outer conductor 29 when the outer conductor 29 is coupled to the connector body 15. The outer conductor seal 35 may also be an o-ring or other form of annular gasket and/or may be over-molded directly upon the second seal groove 33.

To reduce material costs and overall connector assembly weight, a material reduction groove may be located between the mounting portion 13 and the aligning portion 31. Depending upon the coaxial cable 39 dimensions and the selected connection interface for the coaxial cable connector assembly, the diameter of the mounting portion 13 may be smaller than the diameter of the aligning portion 31. To locate the outer conductor seal 35 at a position for contacting the inner diameter of the outer conductor 29, the insulator 1 may extend beyond the connector body 15 at the cable end 11. Further, the aligning portion may be provided with step and/or ramp surfaces to align the outer conductor seal 35 with the outer conductor 29, for example where the outer conductor 29 inner diameter is the same as the inner diameter of a body bore of the connector body 15 at the cable end 11.

In addition to seal design to prevent aluminum oxidation and/or corrosion, an insulator 1 according to the invention may also include a surface sealant 41 (notation 41 in the various figures indicating several possible general surface sealant 41 application area(s), as the surface sealant 41 may be applied in coating thicknesses that are too thin to graphically represent in the various figures) such as an oxidation and/or corrosion inhibitor coating or grease. An example of suitable surface sealant(s) is the family of Dostex™ oxide inhibitors available from Dossert Corporation of Waterbury, Conn., US.

The surface sealant 41 may be applied to the inner conductor seal 25, outer conductor seal 29, first seal groove 23, second seal groove 33, inner contact 3, the cable end 11 of the bore 17 and/or the inner conductor 27.

Where the surface sealant 41 is applied, for example to the inner conductor seal 25 and/or first seal groove 23, displacement of the inner conductor seal 25 into/against the first seal groove 23 as the inner conductor 27 is moved towards the inner contact 3 will spread a coating of the surface sealant 41 upon the inner conductor 27. When the inner contact 3 couples with the surface sealant 41 coated inner conductor 27, the mechanical force of the inner contact 3 will displace the surface sealant 41 from the immediate area of the electrical interconnection, sealing the electrical interconnection from exposure to the atmosphere and any moisture that may be present.

Alternatively, the surface sealant may be applied to exposed surfaces of the electrical interconnection area, coaxial cable connector assembly 5 and/or coaxial cable 39 as a manual step of a method for coupling the coaxial cable connector assembly 5 to the end of the coaxial cable 39.

One skilled in the art will appreciate that the present invention may be easily integrated with existing coaxial connector configurations with a minimum of engineering rework and/or tooling modification. The required modifications may be limited to the exchange of a conventional insulator configuration with an insulator 1 according to the invention.

An insulator 1 according to the invention provides an improved environmental seal located proximate the electrical interconnection connection between the inner conductor 27 and the inner contact 3 thus reducing opportunities for connector failure due to corrosion and/or oxidation inherent in metals such as aluminum alloys when mechanically coupled to dissimilar metals. The insulator 1 according to the invention is especially suited for use in electrical connectors for a coaxial cable 39 with an aluminum inner conductor 11 having a copper or other metal coating about the outer diameter surface 9. Because the exposed end of the inner conductor 27 and the metal coating edge exposed by cable end preparation for coaxial cable connector assembly 5 attachment is protected from moisture and/or air exposure, opportunities for accelerated corrosion of the exposed aluminum and/or related delamination of the metal coating are reduced, especially when a surface sealant 41 is applied to the socket formed by the inner contact 3 and the bore 17 at the cable end 11 prior to insertion of the inner conductor 27, to further exclude air and/or moisture from the area of the electrical interconnection. Similarly, the insulator 1 may be configured to provide a seal against the inner diameter of the outer conductor 29 thereby effectively isolating the coaxial cable connector assembly 5 from any moisture that may be present in or migrating along the inside of the coaxial cable 39.

Although exemplary coaxial cable connector assembly 5 and coaxial cable 39 combinations are provided demonstrating outer conductor 29 threaded clamp retention configurations for annular corrugated (FIGS. 7-9) and smooth walled (FIGS. 5 and 6) coaxial cable(s) 39, one skilled in the art will recognize that the insulator 1 is applicable to any desired coaxial cable connector assembly 5 and coaxial cable 39 combination.

Table of Parts

| | |
|---|---|
| 1 | insulator |
| 3 | inner contact |
| 5 | coaxial cable connector assembly |
| 7 | dielectric body |
| 9 | connector end |
| 11 | cable end |
| 13 | mounting portion |
| 15 | connector body |
| 17 | bore |
| 19 | step |
| 21 | contact portion |
| 23 | first seal groove |
| 25 | inner conductor seal |
| 27 | inner conductor |
| 29 | outer conductor |
| 31 | aligning portion |
| 33 | second seal groove |
| 35 | outer conductor seal |
| 37 | material reduction groove |
| 39 | coaxial cable |
| 41 | surface sealant |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. An insulator for supporting an inner contact within a coaxial cable connector; the coaxial cable connector for coupling with a coaxial cable having an outer conductor and an inner conductor; the insulator comprising:

a monolithic dielectric body provided with a mounting portion proximate a connector end, the mounting portion dimensioned to seat within a connector body of the coaxial cable connector;

a bore through the dielectric body dimensioned to seat the inner contact therein;

an annular first seal groove in an inner diameter of the bore proximate a cable end; and an inner conductor seal disposed in the first seal groove; the inner conductor seal dimensioned to seal between the insulator and the inner conductor when the inner conductor is coupled to the inner contact.

2. The insulator of claim 1, wherein the inner diameter of the bore increases between a connector end and the cable end.

3. The insulator of claim 2, wherein the increase of the inner diameter of the bore between the connector end and the cable end is via a step.

4. The insulator of claim 1, wherein the inner conductor seal is over-molded upon the first seal groove.

5. The insulator of claim 1, further including a surface sealant.

6. The insulator of claim 5, wherein the surface sealant is applied to the inner conductor seal.

7. The insulator of claim 5, wherein the surface sealant is applied to the first seal groove.

8. The insulator of claim 5, wherein the surface sealant is applied to the cable end of the bore.

9. The insulator of claim 1, further including an outer diameter aligning portion of the dielectric body proximate the cable end; the outer diameter aligning portion including an annular second seal groove in an outer diameter; and an outer conductor seal disposed in the second seal groove dimensioned to seal between the insulator and an inner diameter of the outer conductor when the outer conductor is coupled to the connector body.

10. The insulator of claim 9, further including a surface sealant.

11. The insulator of claim 9, wherein the surface sealant is applied to the outer conductor seal.

12. The insulator of claim 9, wherein the surface sealant is applied to the second seal groove.

13. The insulator of claim 9, wherein the outer conductor seal is over-molded upon the second seal groove.

14. The insulator of claim 9, further including a material reduction groove between the mounting portion and the aligning portion.

15. The insulator of claim 9, wherein the mounting portion has a smaller outer diameter than the aligning portion.

16. The insulator of claim 9, wherein the insulator extends beyond the connector body at the cable end.

17. An insulator for supporting an inner contact within a coaxial cable connector; the coaxial cable connector for coupling with a coaxial cable having an outer conductor and an inner conductor; the insulator comprising:

a monolithic dielectric body provided with a mounting portion proximate a connector end, the mounting portion dimensioned to seat within a connector body of the coaxial cable connector;

a bore through the dielectric body dimensioned to seat the inner contact therein;

an annular first seal groove in an inner diameter of the bore proximate a cable end;

an inner conductor seal disposed in the first seal groove; the inner conductor seal dimensioned to seal between the insulator and the inner conductor when the inner conductor is coupled to the inner contact;

an outer diameter aligning portion of the dielectric body proximate the cable end; the outer diameter aligning portion including an annular second seal groove in an outer diameter; and an outer conductor seal disposed in the second seal groove dimensioned to seal between the insulator and an inner diameter of the outer conductor when the outer conductor is coupled to the connector body;

a surface sealant applied to the inner conductor seal and the outer conductor seal; and a material reduction groove between the mounting portion and the aligning portion.

18. A method for sealing the connection between an inner contact and an inner conductor within a coaxial cable connector; comprising:

providing a monolithic dielectric body with a mounting portion proximate a connector end, the mounting portion dimensioned to seat within a connector body of the coaxial cable connector; a bore through the dielectric body dimensioned to seat the inner contact therein; an annular first seal groove in an inner diameter of the bore proximate a cable end; an inner conductor seal disposed in the first seal groove;

applying a surface sealant to at least one of proximate the bore and upon the inner conductor; and inserting the inner conductor into the cable end of the bore past the inner conductor seal into coupling engagement with the inner contact; the inner conductor sealing against the inner conductor seal.

19. The method of claim 18, wherein the surface sealant is applied to the inner conductor seal.

20. The method of claim 18, wherein the surface sealant is applied to the first seal groove.

* * * * *